US010260714B2

(12) United States Patent
Chung

(10) Patent No.: US 10,260,714 B2
(45) Date of Patent: Apr. 16, 2019

(54) LAMP CASING MECHANISM

(71) Applicants: LITE-ON ELECTRONICS (GUANGZHOU) LIMITED, Guangzhou (CN); Lite-On Technology Corporation, Taipei (TW)

(72) Inventor: Fu-Chin Chung, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 15/865,272

(22) Filed: Jan. 9, 2018

(65) Prior Publication Data

US 2019/0078760 A1 Mar. 14, 2019

(30) Foreign Application Priority Data

Sep. 11, 2017 (CN) ..... 2017 1 0813003

(51) Int. Cl.

| | |
|---|---|
| ***F21V 21/00*** | (2006.01) |
| ***F21V 15/01*** | (2006.01) |
| ***F21V 15/04*** | (2006.01) |
| ***F21V 21/30*** | (2006.01) |
| ***F21V 19/02*** | (2006.01) |
| *F21W 131/103* | (2006.01) |

(52) U.S. Cl.

CPC ..... *F21V 15/01* (2013.01); *F21V 15/04* (2013.01); *F21V 19/02* (2013.01); *F21V 21/30* (2013.01); *F21W 2131/103* (2013.01)

(58) Field of Classification Search

CPC ..... F21V 15/01; F21V 19/02; F21V 21/30; F21V 15/04; F21W 2131/103

See application file for complete search history.

(56) References Cited

U.S. PATENT DOCUMENTS

| | | | | | |
|---|---|---|---|---|---|
| 1,872,305 | A | * | 8/1932 | Larson | F21L 4/00 362/185 |
| 2,289,276 | A | * | 7/1942 | Packer | F21L 4/00 362/185 |
| 2,408,783 | A | * | 10/1946 | Kloner | F21S 8/031 362/219 |
| 3,801,812 | A | * | 4/1974 | Palumbo | F21L 14/00 362/293 |
| 4,118,764 | A | * | 10/1978 | Bleiweiss | F21S 43/19 362/369 |
| 4,533,983 | A | * | 8/1985 | Hafstad | F21S 8/033 362/223 |

FOREIGN PATENT DOCUMENTS

| | | | |
|---|---|---|---|
| CN | 203162870 | * | 8/2013 |

* cited by examiner

*Primary Examiner* — Ali Alavi
(74) *Attorney, Agent, or Firm* — JCIPRNET

(57) ABSTRACT

A lamp casing mechanism includes a lamp arm holder, a lamp cover and a fixing member. The lamp arm holder includes a pivoted axle having a first and a second fixing holes. The lamp cover includes a first accommodation trough. The pivoted axle is located in the first accommodation trough. The fixing member includes a fixing portion. The fixing portion is detachably fixed to one of the first and the second fixing holes.

12 Claims, 10 Drawing Sheets

LAMP CASING MECHANISM

CROSS REFERENCE TO RELATED APPLICATION

This application claims the priority benefit of China application serial no. 201710813003.0, filed on Sep. 11, 2017. The entirety of the above-mentioned patent application is hereby incorporated by reference herein and made a part of specification.

BACKGROUND

Field of the Disclosure

The invention relates to a casing mechanism, and specifically relates to a lamp casing mechanism.

Description of Related Art

In the conventional lamp casing mechanism, the lamp cover is assembled with the lamp arm holder. Specifically, the lamp cover may be perpendicularly mounted on the lamp arm holder, this mounting way is generally called as a post top. Alternatively, the lamp cover may be mounted on the the lamp arm holder in parallel, this mounting way is generally called as a side entry. Along with the more and more diversified requirements in use, how to adjust the mounting direction of the lamp cover as required on the premise of convenient operation is target of researchers in the field.

SUMMARY

The invention provides a lamp casing mechanism capable of conveniently adjusting the relative position between the lamp arm holder and the lamp cover.

A lamp casing mechanism of the invention includes a lamp arm holder, a lamp cover and a fixing member. The lamp arm holder includes a pivoted axle, which includes a first fixing hole extending in a first direction and a second fixing hole extending in a second direction. The lamp cover includes a first accommodation trough, and the pivoted axle is located in the first accommodation trough. The fixing member includes a fixing portion, and the fixing portion is detachably fixed to one of the first and the second fixing holes of the pivoted axle.

In one embodiment of the invention, the lamp cover further includes a through groove having an extension length and communicating with the first accommodation trough, the fixing member passes through the through groove and is configured to move along the extension length of the through groove, so that the lamp cover is configured to move relative to the lamp arm holder.

In one embodiment of the invention, the lamp casing mechanism further includes a cushion block located in the first accommodation trough, the cushion block includes a through hole, and the through hole corresponds to one of the first fixing hole and the second fixing hole of the pivoted axle.

In one embodiment of the invention, the fixing member further includes a pressing portion and a connecting portion located between the fixing portion and the pressing portion, the connecting portion penetrates through the through hole of the cushion block, and the pressing portion presses against the lamp cover.

In one embodiment of the invention, the lamp cover further includes a second accommodation trough recessed on an outer surface, and the pressing portion is located in the second accommodation trough.

In one embodiment of the invention, the through hole of the cushion block includes a first segment and a second segment, an inner diameter of the first segment is greater than an outer diameter of the fixing portion, and the second segment has an inner diameter corresponding to the fixing portion.

In one embodiment of the invention, a length of the first segment is greater than or equal to a length of the fixing portion.

In one embodiment of the invention, the cushion block includes an inner arc surface and an outer arc surface opposite each other, the inner arc surface contacts the pivoted axle, the outer arc surface contacts a wall surface of the lamp cover, the wall surface is beside the first accommodation trough of the lamp cover, the through hole passes through the inner arc surface and the outer arc surface, the first segment of the through hole is close to the inner arc surface, and the second segment of the through hole is close to the outer arc surface.

In one embodiment of the invention, the lamp casing mechanism further includes a position-limiting member located in and fixed to the lamp cover, and the position-limiting member presses against the pivoted axle.

In one embodiment of the invention, the position-limiting member includes a body part, a fixing part, and a limiting part, the fixing part and the limiting part are respectively disposed at two ends of the body portion and are bent and extended in two opposite directions, the fixing part is fixed to the lamp cover, and the limiting part presses against the pivoted axle.

A lamp casing mechanism of the invention includes a lamp arm holder, a lamp cover and a fixing member. The lamp arm holder includes a pivoted axle, and the pivoted axle includes a first fixing hole extending in a first direction. The lamp cover includes a first accommodation trough and a through groove having an extension length and communicating with the first accommodation trough, and the pivoted axle is located in the first accommodation trough. The fixing member includes a fixing portion detachably fixed to the first fixing hole of the pivoted axle, and the fixing member passes through the through groove and is configured to move along the extension length of the through groove, so that the lamp cover is configured to move relative to the lamp arm holder.

In one embodiment of the invention, the lamp casing mechanism further includes a cushion block located in the first accommodation trough, the cushion block includes a through hole, the through hole corresponds to the first fixing hole of the pivoted axle and to a part of the through groove, and the fixing member penetrates through the through hole of the cushion block.

In order to make the aforementioned and other features and advantages of the invention more comprehensible, embodiments accompanying figures are described in detail below.

DESCRIPTION OF THE EMBODIMENTS

Figure 1:
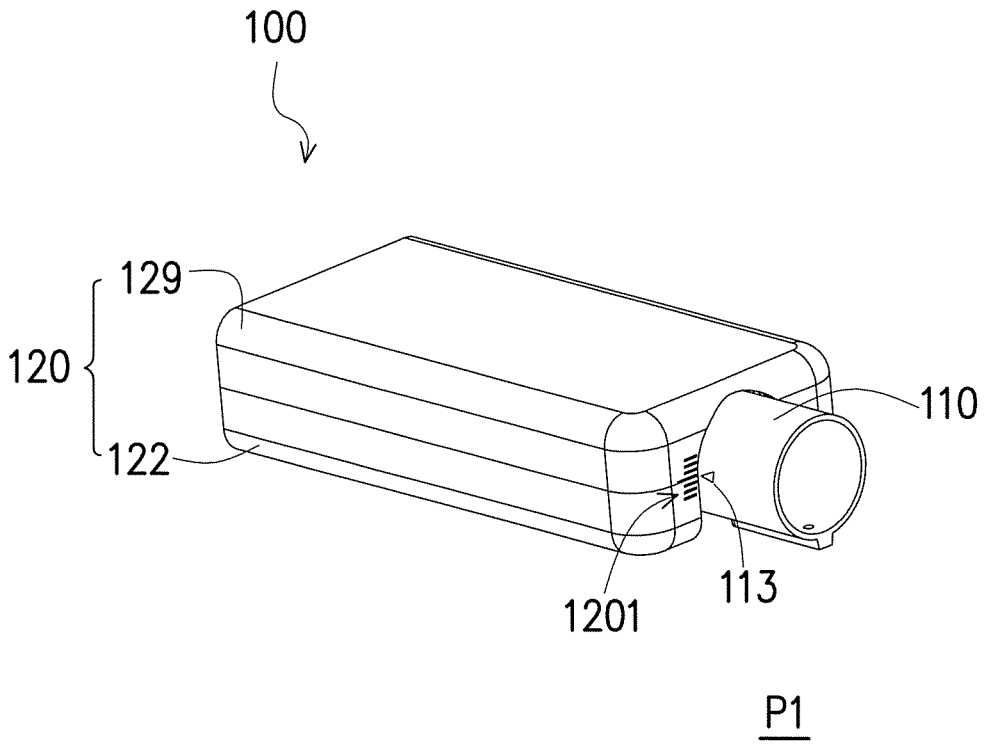
FIG. 1 is a schematic view of a lamp casing mechanism according to one embodiment of the invention.
Figure 2:
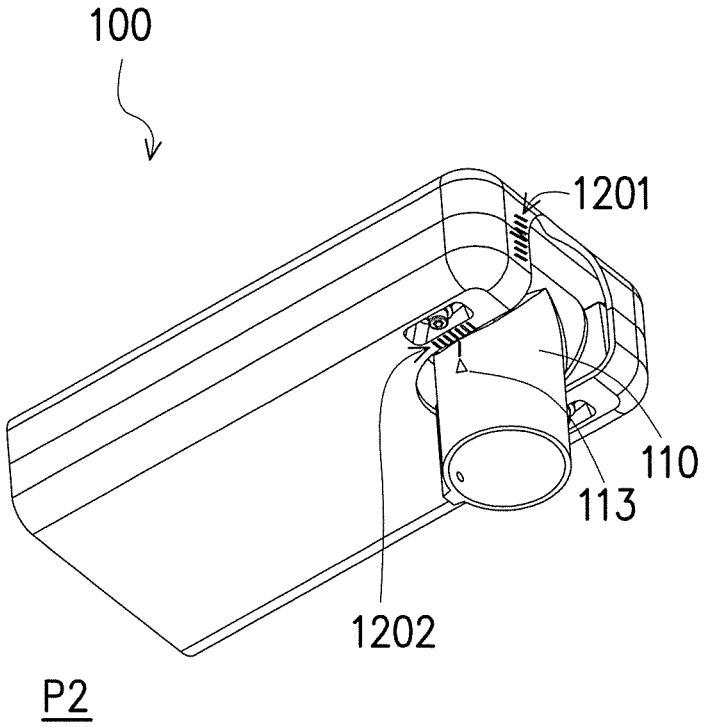
FIG. 2 is a schematic view at a different state of the lamp casing mechanism in FIG. 1.

FIG. 1 is a schematic view of a lamp casing mechanism according to one embodiment of the invention. FIG. 2 is a schematic view at a different state of the lamp casing mechanism in FIG. 1. Referring to FIG. 1 and FIG. 2, a lamp casing mechanism 100 of the present embodiment is a street lamp casing mechanism as an example. In other embodiments, the lamp casing mechanism 100 may also be used for traffic light or other types of light, the application of the lamp casing mechanism 100 is not limited thereto. As seen in FIG. 1 and FIG. 2, a lamp arm holder 110 of the lamp casing mechanism 100 may assemble with a lamp cover 120 in a first position P1 (shown in FIG. 1, such as a side entry) or a second position P2 (shown in FIG. 2, such as a post top), according to different requirements of the user, the details will be described hereinafter.

Figure 3:
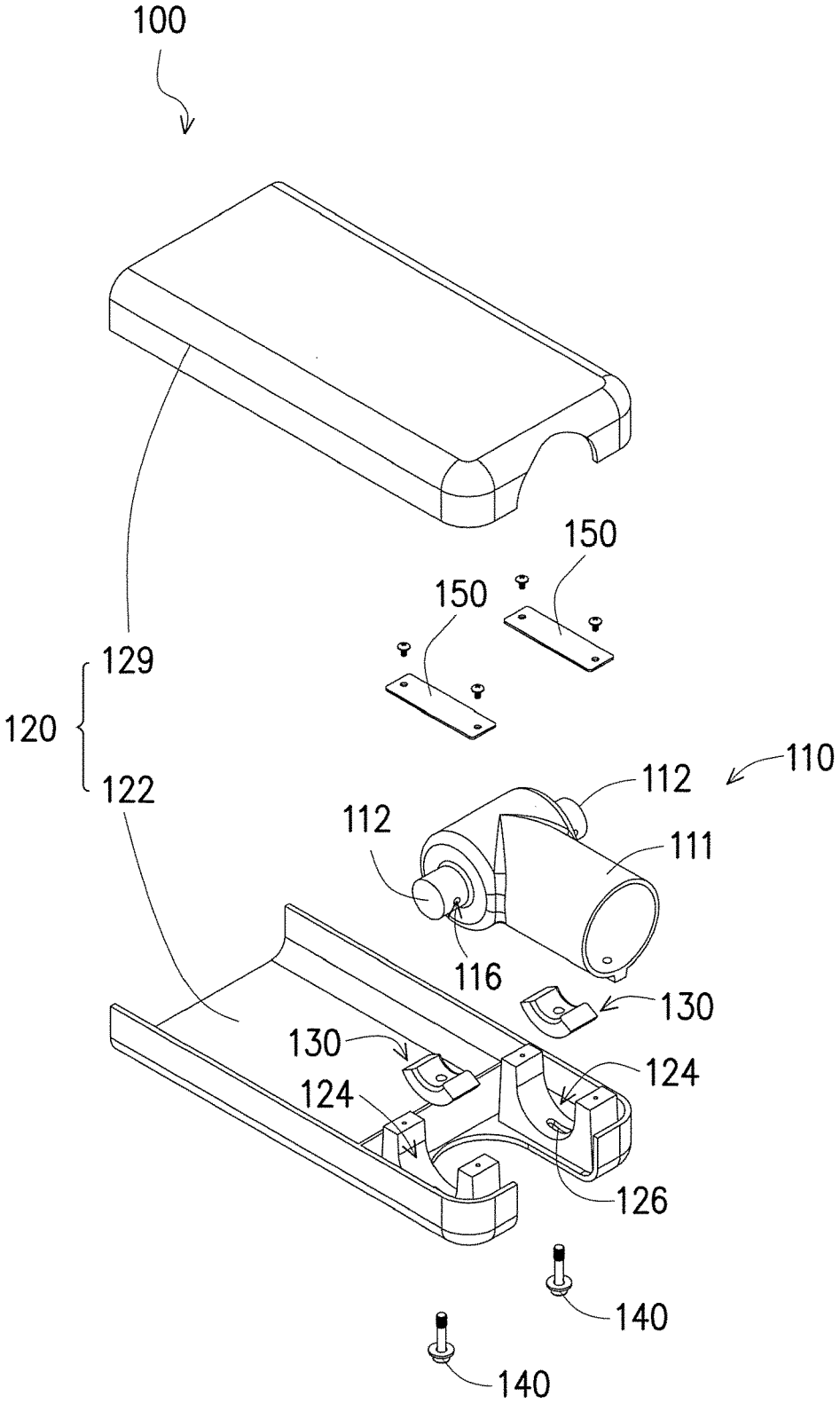
FIG. 3 is a three-dimensional exploded view of the lamp casing mechanism in FIG. 1.
Figure 4A:
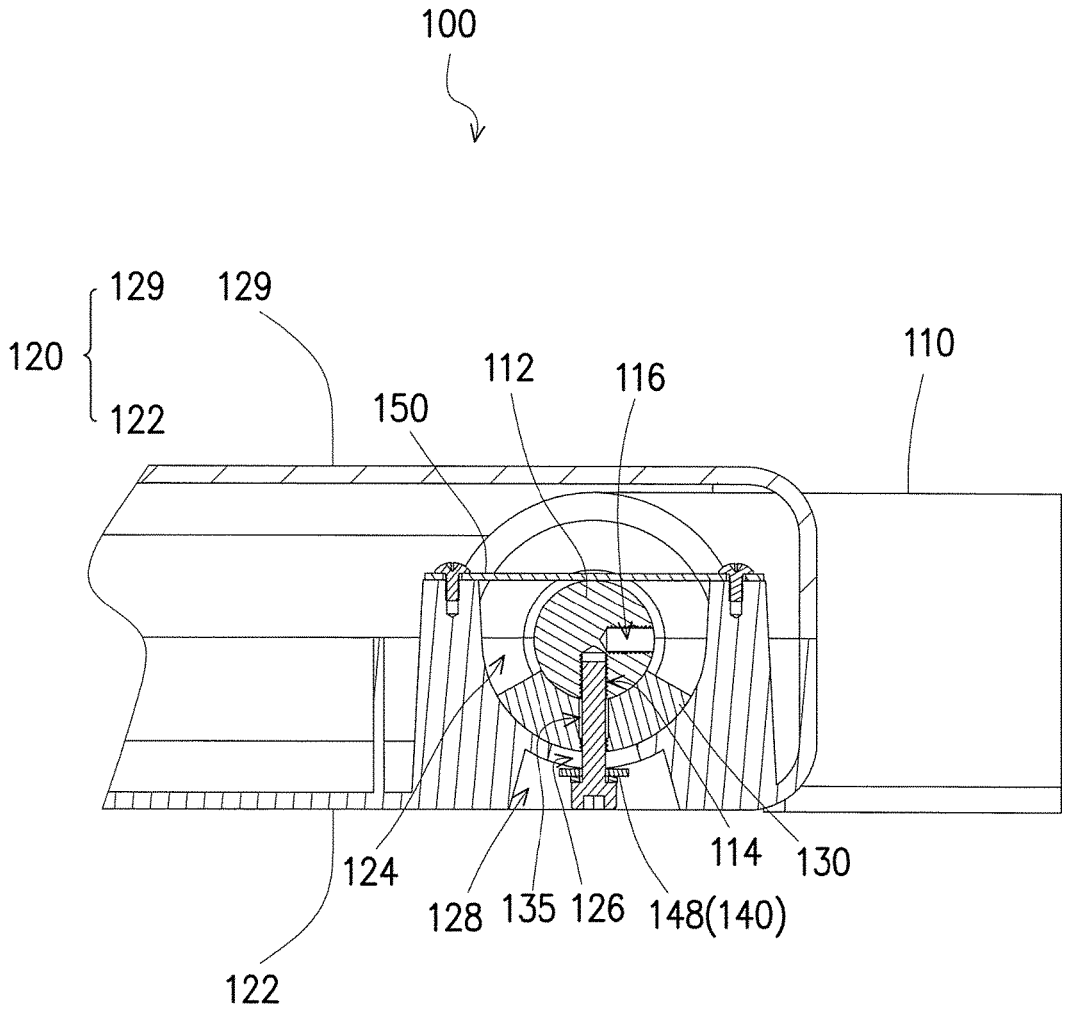
FIG. 4A is a partial cross-sectional view of the lamp casing mechanism in FIG. 1.
Figure 4B:
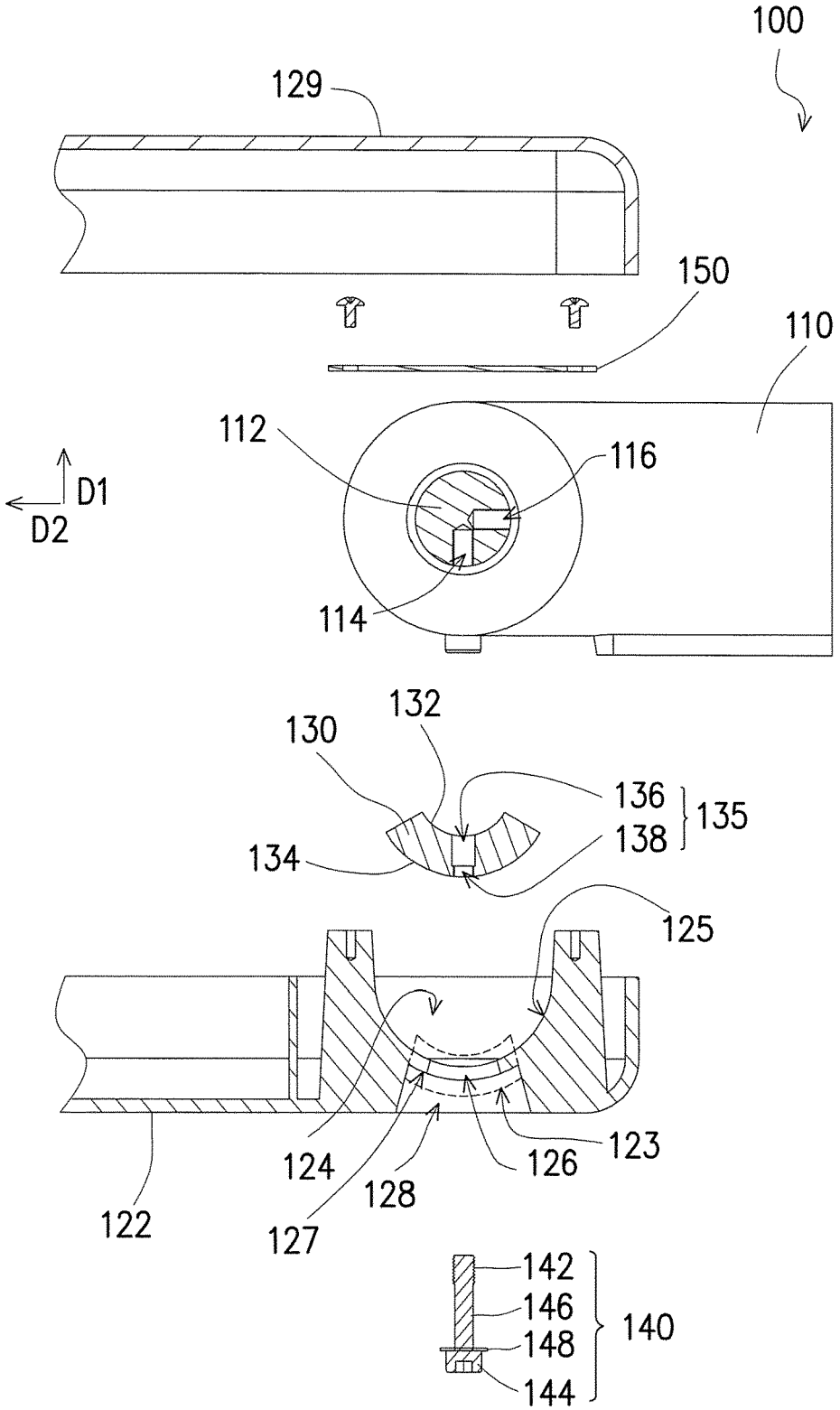
FIG. 4B is a partial cross-sectional and exploded view of the lamp casing mechanism in FIG. 1.

FIG. 3 is a three-dimensional exploded view of the lamp casing mechanism in FIG. 1. FIG. 4A is a partial cross-sectional view of the lamp casing mechanism in FIG. 1. FIG. 4B is a partial cross-sectional and exploded view of the lamp casing mechanism in FIG. 1. Referring to FIG. 3 to FIG. 4B, in the present embodiment, the lamp casing mechanism 100 includes the lamp arm holder 110, the lamp cover 120 connected to the lamp arm holder 110, a cushion block 130 located in the lamp cover 120, a fixing member 140 configured to fix the relative location between the lamp cover 120 and the lamp arm holder 110.

To be more specific, the lamp arm holder 110 includes a pivoted axle 112. As shown in FIG. 4B, the pivoted axle 112 includes a first fixing hole 114 extending in a first direction D1 and a second fixing hole 116 extending in a second direction D2. In the present embodiment, each of the first fixing hole 114 and the second fixing hole 116 is a threaded hole, but the types of the first fixing hole 114 and second fixing hole 116 are not limited thereto. In the present embodiment, the first direction D1 is perpendicular to the second direction D2, but the relationship between the first direction D1 and the second direction D2 are not limited thereto. In the present embodiment, the extending direction of the first fixing hole 114 and the extending direction of the second fixing hole 116 intersect at the axis of the pivoted axle 112. It should be noted here, the pivoted axle 112 is a rotating axle that the lamp arm holder 110 rotates about and with respect to the lamp cover 120, and the pivoted axle 112 is not limited to a central shaft (or located at the center). The extending direction of the pivoted axle 112 may be orthogonal to an extending direction of a segment, which is connected to a light shaft (not shown), of the lamp arm holder 110, and the position of the pivoted axle 112 in the lamp arm holder 110 can also be adjusted and is not limited to the drawings.

The lamp cover 120 includes a first portion 122 and a second portion 129, the second portion 129 can be detachably fixed to the first portion 122. In the present embodiment, the first portion 122 and the second portion 129 are respectively the lower case and the upper case of the lamp cover 120, but the relative relationship of the first portion 122 and the second portion 129 is not limited thereto. As shown in FIG. 4B, in the present embodiment, the first portion 122 includes a first accommodation trough 124 located at the inner surface, a through groove 126 communicated with the first accommodation trough 124, and a second accommodation trough 128 recessed on the outer surface and communicated with the through groove 126. As shown in FIG. 4A, the pivoted axle 112 of the lamp arm holder 110 is located in the first accommodation trough 124, and the second portion 129 and the first portion 122 together cover the pivoted axle 112. In the present embodiment, the first portion 122 of the lamp cover 120 has an arc shape at an area 123 (shown in FIG. 4B) corresponding to the through groove 126. Therefore, the through groove 126 formed in the first portion 122 is an arc-shaped through groove. However, the shape of the through groove 126 is not limited thereto. Otherwise, in the present embodiment, one of the first fixing hole 114 and the second fixing hole 116 of the pivoted axle 112 corresponds to a part of the through groove 126.

In the present embodiment, the cushion block 130 is located in the first accommodation trough 124 of the first portion 122 of the lamp cover 120, and disposed between the pivoted axle 112 and the first portion 122 of the lamp cover 120. To be more specific, in the present embodiment, the cushion block 130 is a fan-shaped column (shown in FIG. 3). As shown in FIG. 4A and FIG. 4B, the cushion block 130 has an inner arc surface 132 and an outer arc surface 134 opposite each other and includes a through hole 135. In the present embodiment, the through hole 135 passes through the inner arc surface 132 and the outer arc surface 134. The through hole 135 corresponds to one of the first fixing hole 114 and the second fixing hole 116 of the pivoted axle 112 and corresponds to a part of the through groove 126. The cushion block 130 contacts the pivoted axle 112 by the inner arc surface 132 and contacts a first wall surface 125 (shown in FIG. 4B), which is located beside the first accommodation trough 124, of the first portion 122 of the lamp cover 120 by the outer arc surface 134. In addition, in the present embodiment, the inner arc surface 132 and the outer arc surface 134 have the same curvature. However, in other embodiments, the curvatures of the inner arc surface 132 and the outer arc surface 134 may be not the same, and the shape of the cushion block 130 is also not limited thereto.

The fixing member 140 includes a fixing portion 142, a screw head 144, a connecting portion 146, and a pressing portion 148. To be more specific, in the present embodiment, the fixing member 140 is a combination of a screw and a washer having a circular hole, the screw includes the fixing portion 142, the screw head 144, and the connecting portion 146 connected between the fixing portion 142 and the screw head 144, the washer having the circular hole is sleeved on the connecting portion 146 and presses against the screw head 144, so that the connecting portion 146 is located between the fixing portion 142 and the pressing portion 148. However, in other embodiments, the fixing member 140 may also be a single component, and the shape of the fixing member 140 is not limited thereto.

In the present embodiment, the fixing portion 142 of the fixing member 140 can be detachably fixed to one of the first fixing hole 114 and the second fixing hole 116 of the pivoted axle 112. In FIG. 4A, the fixing portion 142 is fixed to the first fixing hole 114 of the pivoted axle 112 as an example. At this time, the lamp cover 120 at the first position P1 is disposed to be parallel to the lamp arm holder 110, so as to present the side entry state. The connecting portion 146 penetrates through the through groove 126 and the through hole 135 of the cushion block 130, and is configured to move inside the through groove 126. In the present embodiment, a width of the through groove 126 is smaller than a width of the pressing portion 148, so that the pressing portion 148 presses against a second wall surface 127 (shown in FIG. 4B), which is located beside the through groove 126, of the first portion 122 of the lamp cover 120, so as to generate friction.

As shown in FIG. 4A, in the present embodiment, since the second accommodation trough 128 of the lamp cover 120 is recessed on the outer surface of the first portion 122 of the lamp cover 120, the pressing portion 148 and the screw head 144 of the fixing member 140 may be located in the second accommodation trough 128 of the first portion 122 and do not protrude from the outer surface of the first portion 122 of the lamp cover 120. With this configuration, not only can the appearance of the lamp cover 120 be simplified, but also the pressing portion 148 and the screw head 144 of the fixing member 140 can be protected so as to reduce the probability of colliding with other objects from outside.

Figure 5:
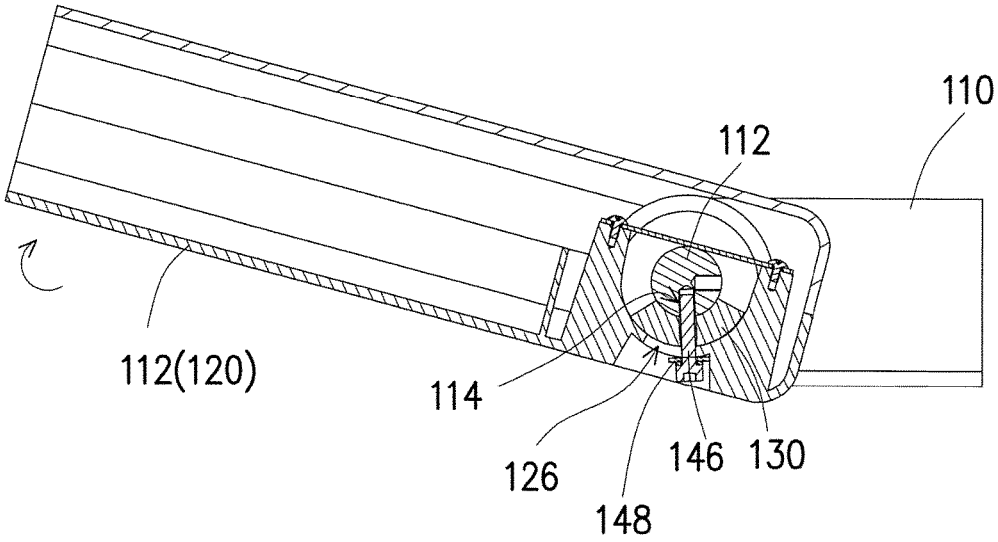
FIG. 5 and FIG. 6, respectively, are cross-sectional schematic views illustrating the relative rotation between the lamp cover and the lamp arm holder of the lamp casing mechanism.
Figure 6:
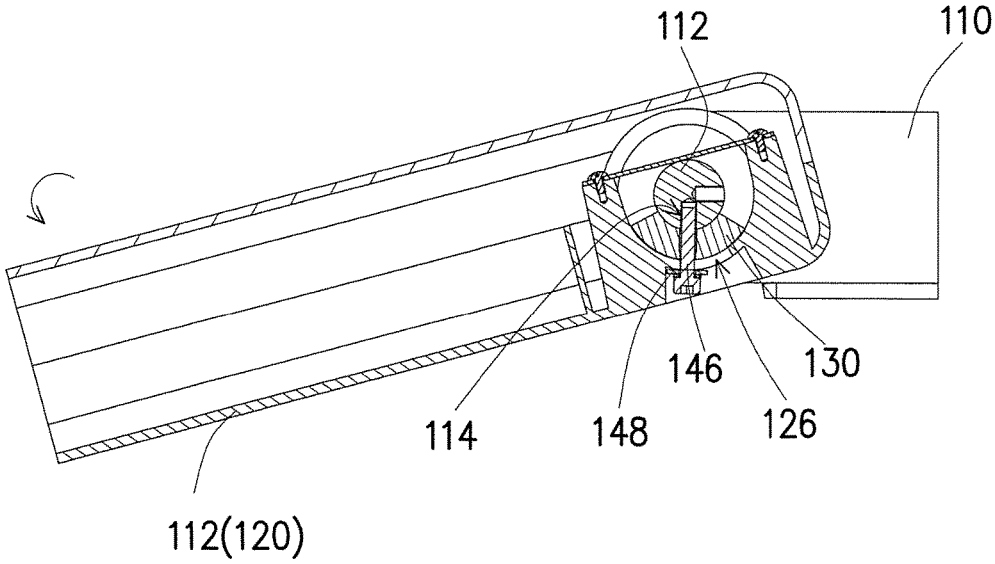

FIG. 5 and FIG. 6, respectively, are cross-sectional schematic views illustrating the relative rotation between the lamp cover and the lamp arm holder of the lamp casing mechanism. Referring to FIG. 4A, FIG. 5, and FIG. 6 simultaneously, in the present embodiment, since the fixing member 140 is fixed to the pivoted axle 112 of the lamp arm holder 110, the lamp arm holder 110 is linked to the fixing member 140, and the through groove 126 of the lamp cover 120 allows the connecting portion 146 of the fixing member 140 to move therein. In the present embodiment, the extension length of the arc-shaped through groove 126 is determined by the designer to allow the lamp cover 120 to rotate an angle with respect to the lamp arm holder 110, so that the lamp cover 120 can rotate along with the fixing member 140 within a desired range with respect to the lamp arm holder 110. Therefore, the angle between the lamp cover 120 and the lamp arm holder 110 can be adjusted, so that the user can fine-tune the angle of the lamp cover 120 as required. As shown in FIG. 3, in the present embodiment, the extension length of the through groove 126 extends in a direction perpendicular to the pivoted axle 112. In other words, the extension length of the through groove 126 extends in a direction parallel to the axis of a segment 111 (such as a hollow tube), which is connected to a light shaft (not shown), of the lamp arm holder 110, as shown in FIG. 3. In a different way, the extension length of the through groove 126 extends in a longitudinal direction of the lamp cover 120. The fixing member 140 passes through the through groove 126 and is configured to move along the extension length of the through groove 126, so that the lamp cover 120 is configured to rotate with respect to the lamp arm holder 110. In the present embodiment, the angle of the lamp cover 120 with respect to the lamp arm holder 110 is adjusted approximately in between positive 15 degrees (FIG. 5) and negative 15 degrees (FIG. 6). In other words, the extending curvature of the through groove 126 is about 30 degrees which is $\pi/6$, the designer determines the extension length of the through groove 126 based on a distance (radius) between the actual position of the through groove 126 and a virtual center. However, the designer can adjust the extending range (curvature) of the through groove 126 according to requirements, so as to provide other rotating angles. The lamp casing mechanism 100 of the present embodiment not only can provide a small range of rotating angle, but also can adjust the assembling position of the lamp cover 120 with respect to the lamp arm holder 110. To be more specific, the lamp cover 120 can be selectively mounted on the lamp arm holder 110 at the first position P1 (such as being amounted in parallel, or the side entry) or at the second position P2 (such as being amounted perpendicularly, or the post top), so as to be in response to different requirements.

It is worth mentioning that, in other present embodiments not shown, the pivoted axle 112 of the lamp arm holder 110 of the lamp casing mechanism may only have the first fixing hole 114 and does not have the second fixing hole 116. In these lamp casing mechanisms, the fixing portion 142 of the fixing member 140 is fixed to the first fixing hole 114 of the pivoted axle 112, the connecting portion 146 passes through the through groove 126 and is configured to move inside the through groove 126, and the extending curvature of the through groove 126 is about 30 degrees which is $\pi/6$. In these embodiments which are not shown, the lamp cover 120 can only be assembled with the lamp arm holder 110 by a single mounting way of side entry or post top, but the lamp cover 120 can still be adjusted with respect to the lamp arm holder 110, such as in between positive 15 degrees and negative 15 degrees, so as to provide the user with a required angle. In addition, in other embodiments, if the lamp cover 120 is not required to rotate an angle with respect to the lamp arm holder 110, the through groove 126 may be omitted. Returning to FIG. 4A, in the present embodiment, the connecting portion 146 of the fixing member 140 passes through the through groove 126 of the lamp cover 120 and the through hole 135 of the cushion block 130, the fixing portion 142 of the fixing member 140 may be fixed to the first fixing hole 114 of the pivoted axle 112 of the lamp arm holder 110, and the pressing portion 148 of the fixing member 140 presses against a part beside the through groove 126 of the lamp cover 120 so that the lamp arm holder 110 is able to be assembled with the lamp cover 120 at the first position (such as side entry).

Figure 7:
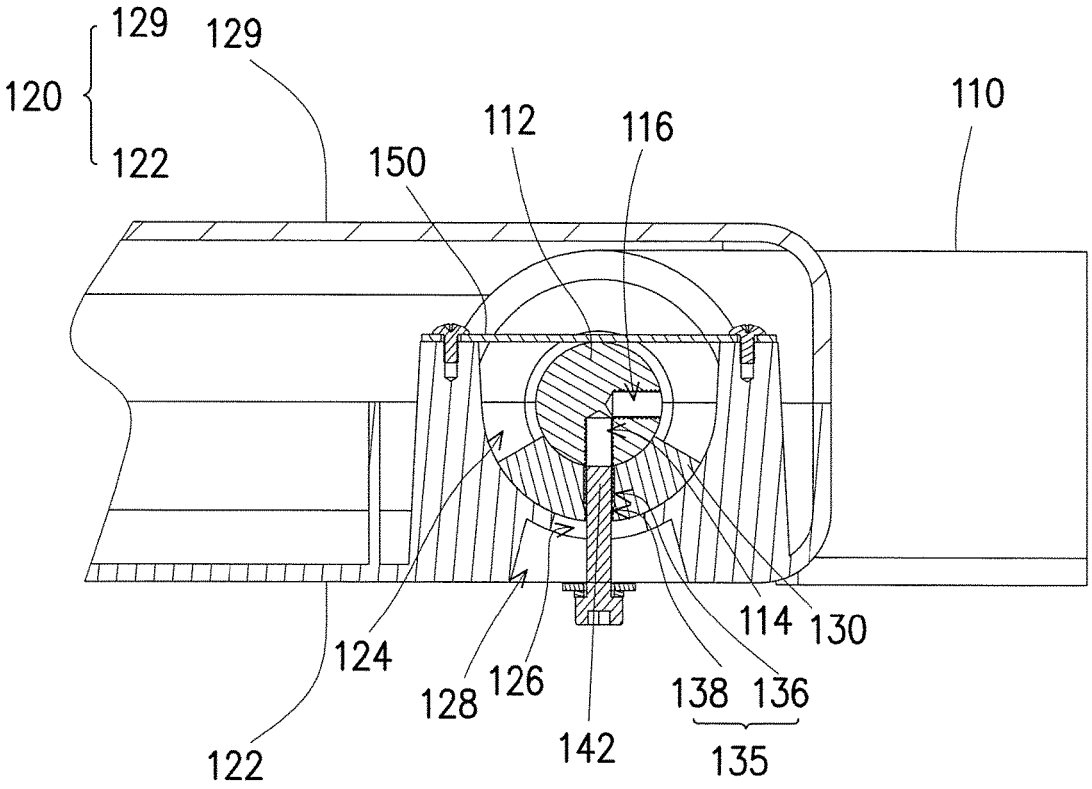
FIG. 7 to FIG. 9 are partial cross-sectional schematic views illustrating that the lamp cover rotates relative to the lamp arm holder from a side entry to a post top in the lamp casing mechanism of FIG. 1.
Figure 8:
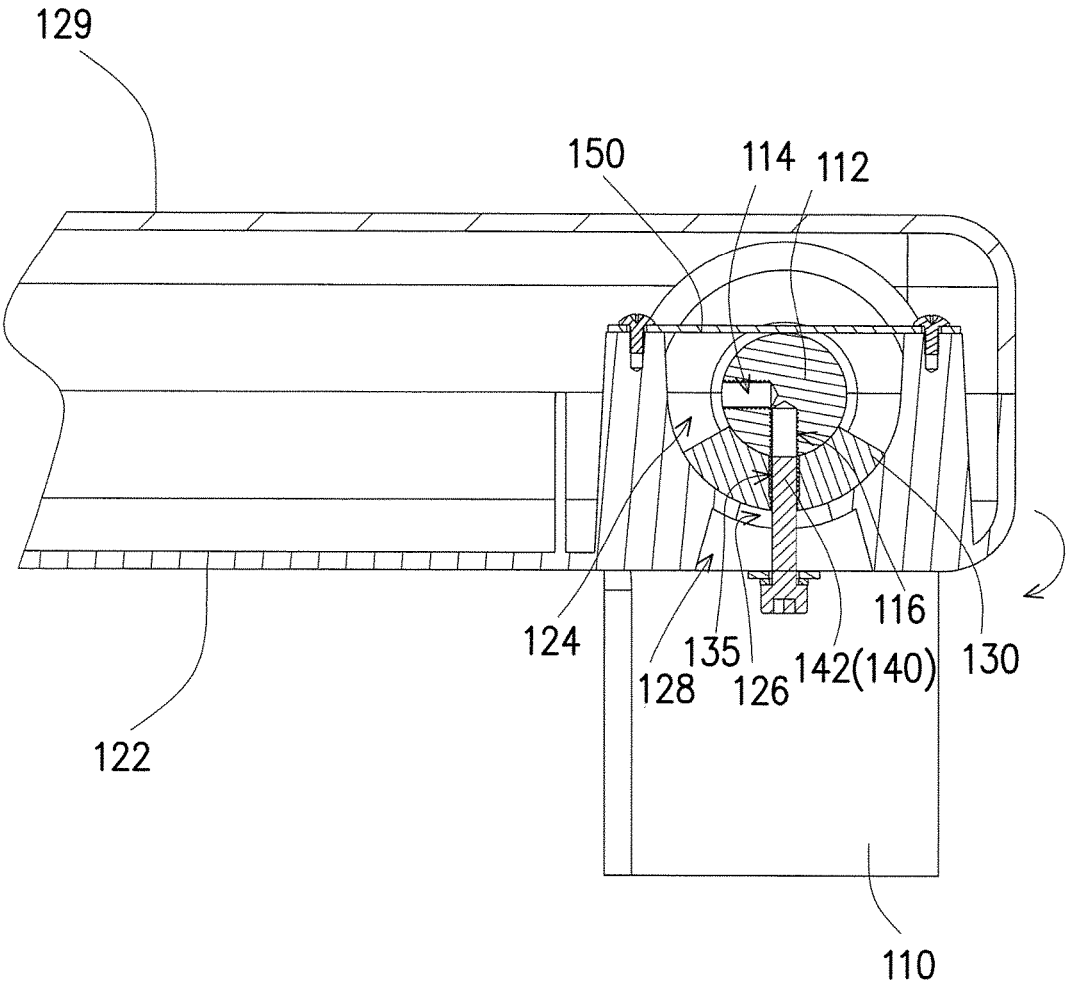
Figure 9:
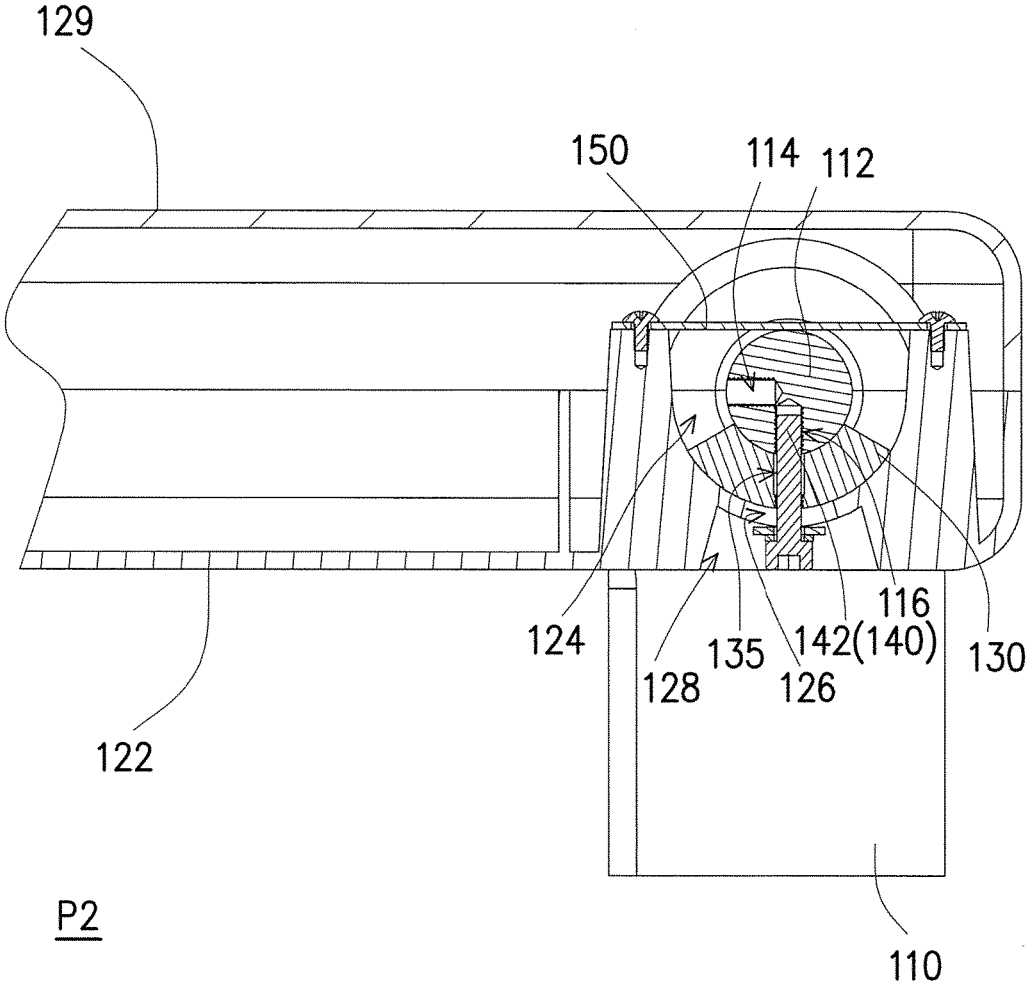

FIG. 7 to FIG. 9 are partial cross-sectional schematic views illustrating that the lamp cover rotates relative to the lamp arm holder from the side entry to the post top in the lamp casing mechanism of FIG. 1. Referring to FIGS. 7-9, when the lamp cover 120 of the lamp casing mechanism 100 is adjusted with respect to the lamp arm holder 110 from the first position P1 (such as side entry) shown in FIG. 4A to the second position P2 (such as post top) shown in FIG. 9, as shown in FIG. 7, firstly, the fixing portion 142 of the fixing member 140 is removed from the first fixing hole 114 of the pivoted axle 112 of the lamp arm holder 110. Next, as shown in FIG. 8, the lamp arm holder 110 is rotated so that the second fixing hole 116 of the pivoted axle 112 is aligned with the through hole 135 of the cushion block 130. Finally, as shown in FIG. 9, the fixing portion 142 of the fixing member 140 is moved up and fixed to the second fixing hole 116 of the pivoted axle 112 of the lamp arm holder 110, so that the lamp arm holder 110 is assembled with the lamp cover 120 at the second position P2 (such as post top direction).

It is worth mentioning that, returning to FIG. 4B, in the present embodiment, the through hole 135 of the cushion block 130 includes a first segment 136 and a second segment 138, the first segment 136 of the through hole 135 is close to the inner arc surface 132, and the second segment 138 of the through hole 135 is close to the outer arc surface 134. The inner diameter of the first segment 136 of the through hole 135 is greater than the outer diameter of the fixing portion 142, and the length of the first segment 136 is greater than or equal to the length of the fixing portion 142. The second segment 138 of the through hole 135 has an inner diameter corresponding to the fixing portion 142. In the present embodiment, the second segment 138 of the through hole 135 has an internal thread corresponding to an external thread of the fixing portion 142.

In the lamp casing mechanism 100 of the present embodiment, since the through hole 135 of the cushion block 130 is designed to have two segments as mentioned above, as shown in FIG. 7, after the fixing portion 142 of the fixing member 140 is removed from the first fixing hole 114 of the pivoted axle 112 of the lamp arm holder 110, the fixing portion 142 is located at the first segment 136 of the through hole 135 and is locked by the second segment 138 of the through hole 135, so that the fixing portion 142 is unable to be directly dropped out from the through hole 135. To be more specific, since the second segment 138 of the through hole 135 has an internal thread corresponding to the fixing portion 142, if the fixing portion 142 of the fixing member 140 is desired to pass through the second segment 138 of the through hole 135, the fixing portion 142 needs to be rotated to go through out of the second segment 138 of the through hole 135. Therefore, if the user does not rotate the fixing portion 142 of the fixing member 140 to go through out of the second segment 138 of the through hole 135, the fixing portion 142 of the fixing member 140 does not fall off the second segment 138 of the through hole 135.

In other words, after the user rotates and removes the fixing portion 142 of the fixing member 140 out from the first fixing hole 114 of the pivoted axle 112, the fixing portion 142 of the fixing member 140 only moves to the first segment 136 of the through hole 135 and is locked at the neck between the first segment 136 and the second segment 138 of the through hole 135. At this time, since the pivoted axle 112 is not interfered by the fixing portion 142 of the fixing member 140 and can be rotated, the second fixing hole 116 of the pivoted axle 112 can be rotated to a position corresponding to the through hole 135 of the cushion block 130. Thereafter, the fixing portion 142 of the fixing member 140 is moved up and fixed to the second fixing hole 116 of the pivoted axle 112, so as to re-fix the fixing member 140 to the pivoted axle 112. Therefore, in process of adjusting the relative location between the lamp cover 120 and the lamp arm holder 110, the fixing member 140 is locked at the neck between the first segment 136 and the second segment 138 of the through hole 135 of the cushion block 130 and is not completely detached from the lamp cover 120, so as to avoid losing the fixing member 140. The user can single-handedly operates the whole adjusting process, so the operation is convenient. After the pivoted axle 112 is re-positioned, the user also does not need to additionally align the fixing portion 142 of the fixing member 140 with the through groove 126 of the first portion 122 of the lamp cover 120 and the through hole 135 of the cushion block 130, so as to effectively reduce operating time. However, in other embodiments, the cushion block 130 may also be omitted.

It is worth mentioning that, in the embodiment of FIG. 1 and FIG. 2, the pivoted axle 112 includes an alignment arrowhead 113, and the lamp cover 120 includes a first graduated area 1201 and a second graduated area 1202. The lamp arm holder 110 can be accurately positioned relative to the lamp cover 120 by aligning the alignment arrowhead 113 with the graduations on the first graduated area 1201 or the second graduated area 1202 of the lamp cover 120. For example, as shown in FIG. 1, when the alignment arrowhead 113 of the lamp arm holder 110 is aligned with the middle mark of the first graduated area 1201, the lamp arm holder 110 is located at the first position P1 with respect to the lamp cover 120. As shown in FIG. 2, when the alignment arrowhead 113 of the lamp arm holder 110 is aligned with the middle mark of the second graduated area 1202, the lamp arm holder 110 is located at the second position P2 with respect to the lamp cover 120. Moreover, in the first graduated area 1201 or the second graduated area 1202, when the alignment arrowhead 113 of the lamp arm holder 110 is turned to an adjacent mark, it represents that the lamp cover 120 rotates, for example, 5 degrees with respect to the lamp arm holder 110. Therefore, in the present embodiment, the lamp cover 120 at the side entry or the post top is able to further rotate with respect to the lamp arm holder 110 an angle between positive 15 degrees and negative 15 degrees. As shown in FIG. 5 and FIG. 6, the lamp cover 120 at the side entry can rotate up or down a specific angle with respect to the lamp arm holder 110. However, the rotating angle represented by the two adjacent marks is not limited thereto.

Moreover, as shown in FIG. 4A, the lamp casing mechanism 100 of the present embodiment further includes a position-limiting member 150, the position-limiting member 150 is located in the lamp cover 120 and fixed to the first portion 122. In the present embodiment, the first accommodation trough 124 is an U-shaped trough, the pivoted axle 112 is located in the first accommodation trough 124 and between the first portion 122 and the position-limiting member 150, the position-limiting member 150 presses against the pivoted axle 112 and covers the opening of the U-shaped trough, so as to prevent the pivoted axle 112 from moving up and leaving the first accommodation trough 124. As a result, the position of the axis of the pivoted axle 112 can be fixed with respect to the first accommodation trough 124. In the present embodiment, the position-limiting member 150 is a strip-shaped plate that is fixed to a portion, which is close to an opening of the first accommodation trough 124, of the first portion 122 by screwing, but the shape of the position-limiting member 150 and the method of fixing to the first portion 122 are not limited thereto.

Figure 10:
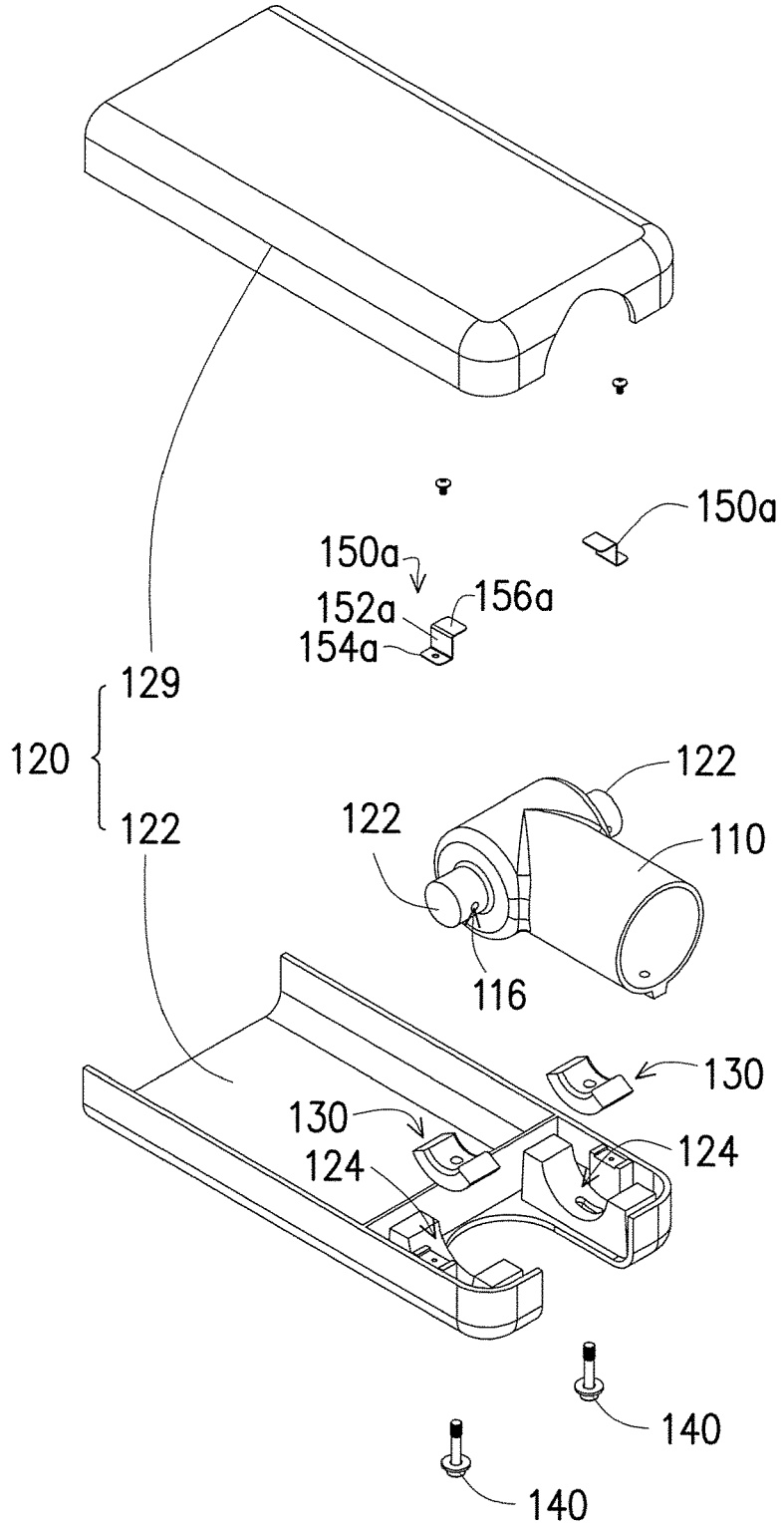
FIG. 10 is an exploded schematic view illustrating another way to limit a pivoted axle of a lamp casing mechanism according to another embodiment of the invention.

FIG. 10 is an exploded schematic view illustrating another way to limit a pivoted axle 112 of a lamp casing mechanism according to another embodiment of the invention. It should be noted here, in the present embodiment, the same or similar reference numbers represent the same or similar elements in the previous embodiment and will not be described hereinafter, and only the main differences are described below. Referring to FIG. 10, the main difference between the present embodiment and the previous embodiment is the shape of the position-limiting members 150 and 150*a*. In the present embodiment, the position-limiting member 150*a* includes a body part 152*a*, a fixing part 154*a*, and a limiting part 156*a*, the fixing part 154*a* and the limiting part 156*a* are respectively disposed at two ends of the body portion 152*a* and are bent and extended in two opposite directions, so that the shape of the position-limiting member 150*a* is close to Z shape. The position-limiting member 150*a* is fixed to the first portion 122 by the fixing part 154*a* and presses against the pivoted axle 122 by the limiting part 156*a*. Similarly, the position-limiting member 150*a* prevents the pivoted axle 112 from moving up and leaving the first accommodation trough 124.

Summarily, in the lamp casing mechanism of the invention, the connecting portion of the fixing member passes through the through groove of the lamp cover and the through hole of the cushion block, the fixing portion of the fixing member may be fixed to the first fixing hole of the pivoted axle of the lamp arm holder, and the pressing portion of the fixing member presses against a part, which is beside the through groove, of the lamp cover so that the lamp arm holder is able to assemble with the lamp cover at the first position (such as side entry). When adjusting the position of the lamp arm holder with respect to the lamp cover, it only needs to remove the fixing portion of the fixing member from the first fixing hole of the pivoted axle of the lamp arm holder and then rotate the lamp arm holder so that the second fixing hole of the pivoted axle is aligned with the through hole of the cushion block, and then the fixing portion of the fixing member is fixed to the second fixing hole of the pivoted axle of the lamp arm holder, thus the lamp arm holder is assembled with the lamp cover at the second position (such as post top), so as to satisfy different requirements of the user. Otherwise, in the lamp casing mechanism of the invention, since the through hole of the cushion block is designed to have the first segment and the second segment, in the process of adjusting the relative location between the lamp cover and the lamp arm holder, the fixing member may not be completely detached from the lamp cover, and the user does not need to re-align the fixing portion of the fixing member with the through groove of the first portion of the lamp cover and the through hole of the cushion block, so as to provide convenience of operating. Further, in the lamp casing mechanism of the invention, since the fixing member is fixed to the pivoted axle of the lamp arm holder, the lamp arm holder is linked to the fixing member, and since the through groove of the lamp cover allows the connecting portion of the fixing member to move inside the through groove, the lamp cover can rotate along with the fixing member and with respect to the lamp arm holder. Therefore, when the lamp cover is located at either the first position (such as side entry) or the second position (such as post top) with respect to the lamp arm holder, the angle of the lamp cover with respect to the lamp arm holder can still be further adjusted within the extending range of the through groove.

It will be apparent to those skilled in the art that various modifications and variations can be made to the structure of the invention without departing from the scope or spirit of the invention.

What is claimed is:

1. A lamp casing mechanism, comprising:

a lamp arm holder, comprising a pivoted axle, wherein the pivoted axle comprises a first fixing hole extending in a first direction and a second fixing hole extending in a second direction;

a lamp cover, comprising a first accommodation trough, wherein the pivoted axle is located in the first accommodation trough; and a fixing member, comprising a fixing portion, wherein the fixing portion is detachably fixed to one of the first and the second fixing holes of the pivoted axle.

2. The lamp casing mechanism as recited in claim 1, wherein the lamp cover further comprises a through groove having an extension length and communicating with the first accommodation trough, the fixing member passes through the through groove and is configured to move along the extension length of the through groove, so that the lamp cover is adapted to move relative to the lamp arm holder.

3. The lamp casing mechanism as recited in claim 2, further comprising:

a cushion block, located in the first accommodation trough, the cushion block comprises a through hole, wherein the through hole corresponds to one of the first fixing hole and the second fixing hole of the pivoted axle.

4. The lamp casing mechanism as recited in claim 3, wherein the fixing member further comprises a pressing portion and a connecting portion located between the fixing portion and the pressing portion, the connecting portion penetrates through the through hole of the cushion block, and the pressing portion presses against the lamp cover.

5. The lamp casing mechanism as recited in claim 4, wherein the lamp cover further comprises a second accommodation trough recessed on an outer surface, and the pressing portion is located in the second accommodation trough.

6. The lamp casing mechanism as recited in claim 3, wherein the through hole of the cushion block comprises a first segment and a second segment, an inner diameter of the first segment is greater than an outer diameter of the fixing portion, and the second segment has an inner diameter corresponding to the fixing portion.

7. The lamp casing mechanism as recited in claim 6, wherein a length of the first segment is greater than or equal to a length of the fixing portion.

8. The lamp casing mechanism as recited in claim 3, wherein the cushion block comprises an inner arc surface and an outer arc surface opposite each other, the inner arc surface contacts the pivoted axle, the outer arc surface contacts a wall surface of the lamp cover, the wall surface is beside the first accommodation trough, the through hole passes through the inner arc surface and the outer arc surface, the first segment of the through hole is close to the inner arc surface, and the second segment of the through hole is close to the outer arc surface.

9. The lamp casing mechanism as recited in claim 1, further comprising:

a position-limiting member, located in and fixed to the lamp cover, wherein the position-limiting member presses against the pivoted axle.

10. The lamp casing mechanism as recited in claim 9, wherein the position-limiting member comprises a body part, a fixing part, and a limiting part, the fixing part and the limiting part are respectively disposed at two ends of the body portion and are bent and extended in two opposite directions, the fixing part is fixed to the lamp cover, and the limiting part presses against the pivoted axle.

11. A lamp casing mechanism, comprising:

a lamp arm holder, comprising a pivoted axle, wherein the pivoted axle comprises a first fixing hole extending in a first direction;

a lamp cover, comprising a first accommodation trough and a through groove having an extension length and communicating with the first accommodation trough, wherein the pivoted axle is located in the first accommodation trough; and a fixing member, comprising a fixing portion, wherein the fixing portion is detachably fixed to the first fixing hole of the pivoted axle, the fixing member passes through the through groove and is configured to move along the extension length of the through groove, so that the lamp cover is adapted to move relative to the lamp arm holder.

12. The lamp casing mechanism as recited in claim 11, further comprising:

a cushion block, located in the first accommodation trough, the cushion block comprises a through hole, wherein the through hole corresponds to the first fixing hole of the pivoted axle and a part of the through groove, and the fixing member penetrates through the through hole of the cushion block.

* * * * *